United States Patent [19]

Ashihara

[11] Patent Number: 4,964,636

[45] Date of Patent: Oct. 23, 1990

[54] POLICE BATON WITH ROTATABLE CROSSHANDLE

[76] Inventor: Hideyuki Ashihara, Matsuyama, Japan

[21] Appl. No.: 312,988

[22] Filed: Feb. 21, 1989

[30] Foreign Application Priority Data

| | | | |
|---|---|---|---|
| Feb. 23, 1988 | [JP] | Japan | 63-41573 |
| Sep. 5, 1988 | [JP] | Japan | 63-223098 |
| Jan. 11, 1989 | [JP] | Japan | 1-5485 |

[51] Int. Cl.[5] ..... F41B 15/02

[52] U.S. Cl. ..... 273/84 R

[58] Field of Search ..... 273/84 R, 73 J, 75, 273/80 D, 81 C; 135/66

[56] References Cited

U.S. PATENT DOCUMENTS

| | | | |
|---|---|---|---|
| 1,842,922 | 1/1932 | Frantzius . | |
| 2,391,782 | 12/1945 | Hutchison | 273/84 |
| 3,716,170 | 2/1973 | Mangels | 222/162 |
| 3,716,710 | 2/1973 | Mangels | 222/162 |
| 4,109,912 | 8/1978 | Zentmyer | 273/84 |
| 4,132,409 | 1/1979 | Taylor | 273/84 |
| 4,203,599 | 5/1980 | Starrett | 273/84 |
| 4,479,171 | 10/1984 | Mains | 362/102 |
| 4,694,981 | 9/1987 | Miller, Jr. | 224/251 |
| 4,739,990 | 4/1988 | Aguirre et al. | 273/84 |

FOREIGN PATENT DOCUMENTS

| | | |
|---|---|---|
| 831626 | 6/1938 | France . |
| 1287775 | 2/1952 | France . |
| 2491719 | 10/1980 | France . |

*Primary Examiner*—Edward M. Coven
*Assistant Examiner*—W. Pierce
*Attorney, Agent, or Firm*—Armstrong, Nikaido, Marmelstein, Kubovcik & Murray

[57] ABSTRACT

A guard baton which comprises a longitudinal club having a crosshandle transversely branched at a place toward a club end and the crosshandle is connected such that the club can be turned around the crosshandle wherein the turnable club is slidably contacted with main portion of the crosshandle at a plane adjacent to the mounting base, thereby enlarged KARATE actions being enable, and additional improvement is directed to devices to quickly stop a swing motion of the club and to devices to shoot light or a gas for increase to defend self against an assailant.

22 Claims, 10 Drawing Sheets

POLICE BATON WITH ROTATABLE CROSSHANDLE

FIELD OF THE INVENTION

This invention relates to a guard baton or police billy or the like. Particularly, this relates to a crosshandled guard baton.

DESCRIPTION OF THE CONVENTIONAL ART

The term "a crosshandled guard baton" is intended to indicate a guard baton which has a short handle branchedly secured on a main club body at midway between an end and a central portion of the club length. A guard baton of this type is described in U.S. Pat. No. 4132409 which has been only the sole conventional art according to the inventor's knowledge.

In this U.S. patent, the handle is axially divided to two portions, stationary and rotatable, and the description therein teaches that the stationary one is acted when braking for rotating or swinging motions of the club is intended. However, in view of the fact that it is not determinable whether the handle is gripped by the right hand or the left hand of a baton user, and a change of gripping the handle from the right hand to left or vice versa is probable. Thus, a device for braking the rotating club should be improved to be more convenient to prepare for gripping by either hand, which was the starting point of this invention and, in addition thereto, new devices are introduced to this inventive baton as the description herein proceeds.

On the other hand, KARATE, a kind of sports or practice for combat without a hand weapon, has become popular in the world and such a combat practice is sometimes used by an assailant to the police or security personnel and therefore, those who are entitled to wear such a guard property as a baton are desirous that their guard property be improved, in particular, be improved so as to realize KARATE actions in enlarged scale, to which purpose a rotatable crosshandled baton is basically appropriate and improvement in the braking device with a guard baton is found to be suited, because in KARATE techniques wielding of two hands is important, but at the same time, quick stop of a hand action is necessary to make use of the foot to kick or to add an attack by footwork.

SUMMARY OF THE INVENTION

The present invention is summarized as disclosing a guard baton which comprises a longitudinal club having a crosshandle (hereinlater "crosshandle" is often shortened to "handle") transversely branched at a place toward a club end and the handle is connected such that the club can be turned around the handle wherein the turnable club is slidably contacted with main portion of the handle at a plane adjacent to the mounting base of the handle and respective devices for acting braking action and/or other functions on the rotating club will be explained in the following with reference to the drawings.

DESCRIPTIONS OF THE EMBODIMENTS

Figure 1:
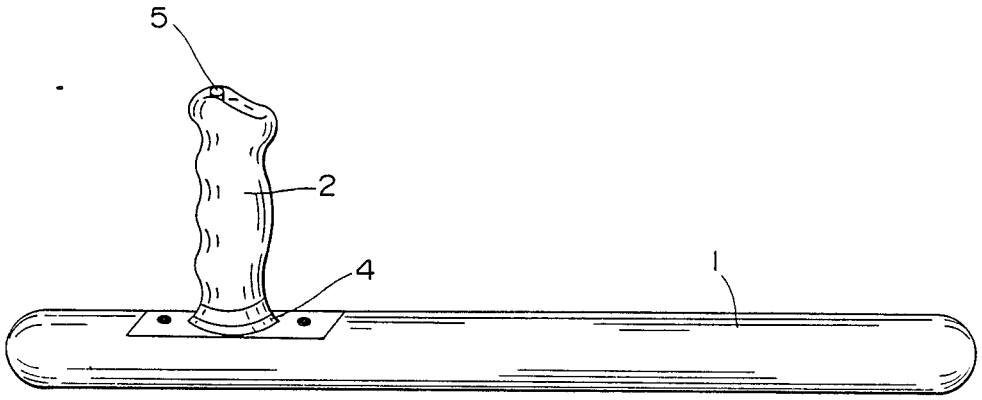
FIG. 1 shows a perspective view of an inventive embodiment wherein a longitudinal length of the club and the same of the handle is not proportional to the scale.
Figure 2:
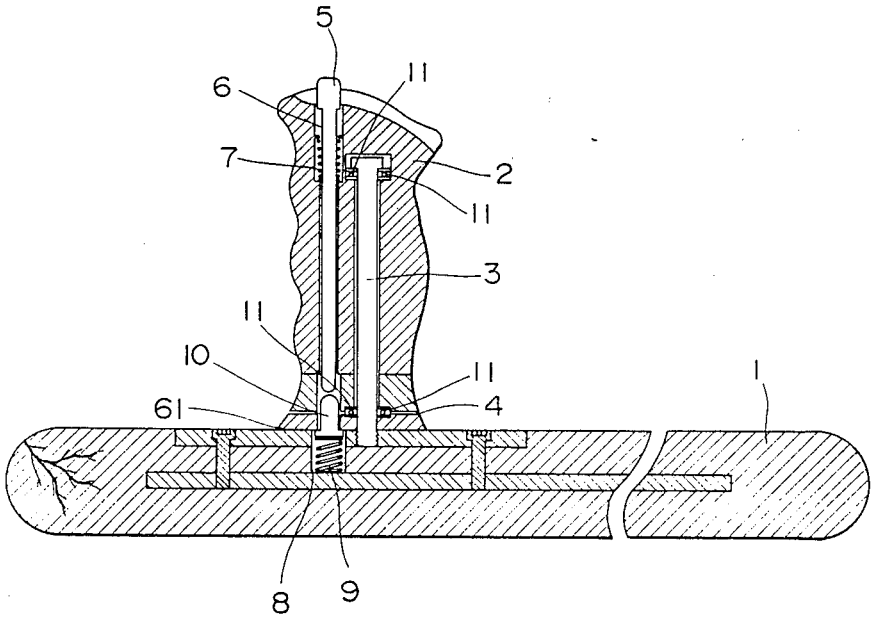
FIG. 2 shows a vertically sectioned view of the embodiment as shown in FIG. 1.

With reference to FIGS. 1 and 2, first, the numeral 1 indicates a club having a longitudinal axis and 2 indicates a crosshandle which is branchedly mounted at a place toward an end of the club and has a longitudinal axis transversal to the club axis, wherein the handle is provided with an elliptical shape in section, of which the major axis is substantially conformed to the club axis, and the handle is also provided preferably with a length comparable to a breadthal length or of a man's palm. The reference numeral 4 designates a plane to form a slide contact made of metal or an interspace between a main portion of the handle to be out of club motion and a mounting base 61 of the handle to be integral with the club motion as will be apparent by description later.

Referring to internal structures, 5 is a rod which is inserted through a hole provided in parallel to the handle axis and at its far end, the rod is blocked and is leveled to be just over the handle end so that a user may manipulate the rod end as a key or trigger and at an outer portion 6 the rod is wound around with a coil spring 7 set on a stepped corner of the hole to yield a urging action and, the end of the rod 5, close to the club 1 is abutted with a pin 10 which is provided in alignment to the rod and is urged with a coil spring 9 received in a bore 8 provided in the club 1 so that the abutted point will stay normally to be outer the plane 4 and will displace inwardly upon a push of the rod end, wherein the rod 5 and the pin 10 are formed to be round to make a point contact each other.

A shaft 3 is provided internally of the handle 2 substantially parallel to the rod 5 and the shaft is received in a hole and is rotatably supported with ball bearings 11, 11 which are provided at an outer point and at the plane 4, but at its close end, the shaft 3 is secured in the club 1 so that the shaft 5 will rotate integrally with club, but the main portion of the handle which designates portion of the handle outer or farther than the plane 4 will stay out of such a rotation by dint of the rotatable supports 11, 11.

Thus, normally the pin 10 stays across the plane 4 which resists to any rotation around the shaft 3, but upon a push of the rod 5, the abutting point comes to be flush with or a slightly inner the plane 4, the club 1 is allowed to rotation which is braked by a release of pushing on the rod end.

Note: in the following descriptions to explain new embodiments, explanations will concentrate to new devices or functions which have not yet been described, with abbreviation for repeated description.

Figure 3:
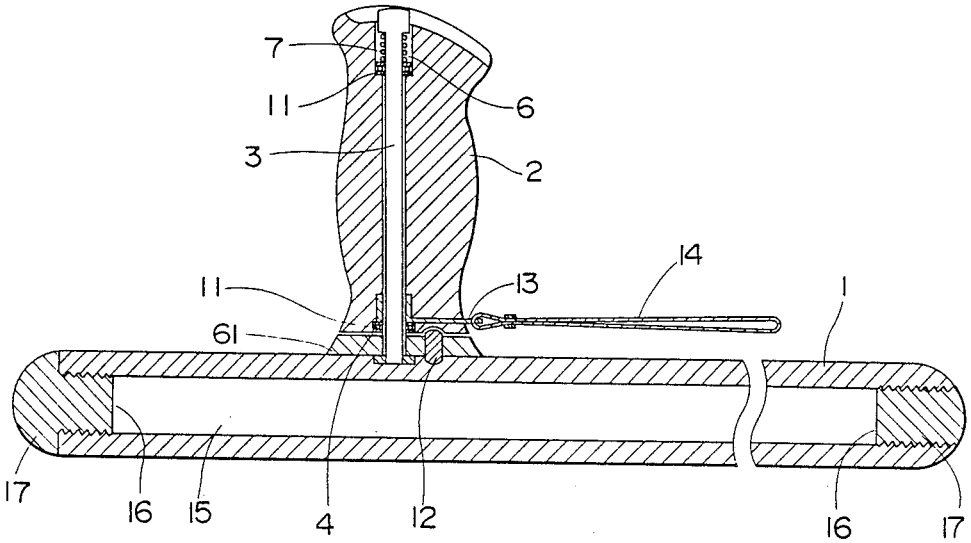
FIG. 3 shows a vertically sectioned view of another inventive embodiment.

With reference to FIG. 3, a shaft 3 is designed to act as a rotating shaft as well as a rod to release resistance to rotation which is assigned to a pin 12. That is, the pin 12 is secured in the club through the mounting base 61 and is extended across the plane 4 slightly in a recess provided with the main portion of the handle. Therefore, when the handle 2 is pulled or displaced outwardly relative to the shaft 3 to make an interspace to be clear of an end of the pin 12, the club is allowed to turn and a release of pull force acting on the handle will brake, wherein a spring 7 will reset the shaft 3. In this embodiment, a ring strap band 14 is provided to make sure a gripping by the hand which is tied with a mounting end 13, location of such a mounting end may be chosen any place around the handle. Further, interior of the club is rendered to be a hollow space 15 to make the baton lighter in weight and two end openings 16 are closed by plugs 17.

Figure 4:
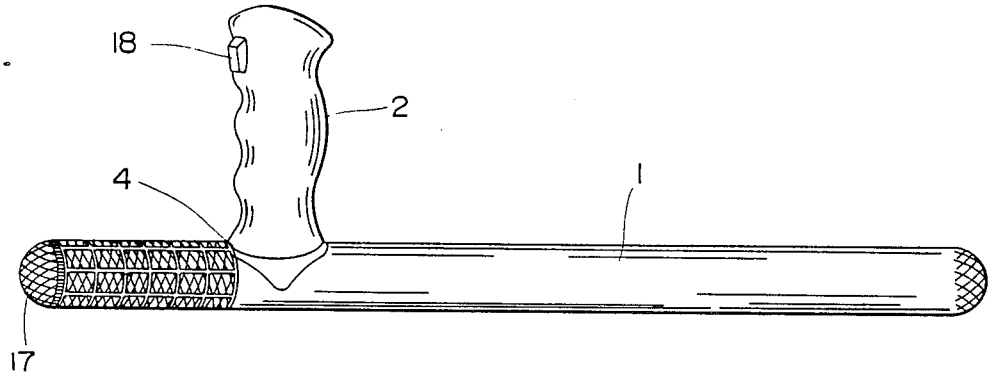
FIG. 4 shows a perspective view of a still another inventive embodiment.
Figure 5:
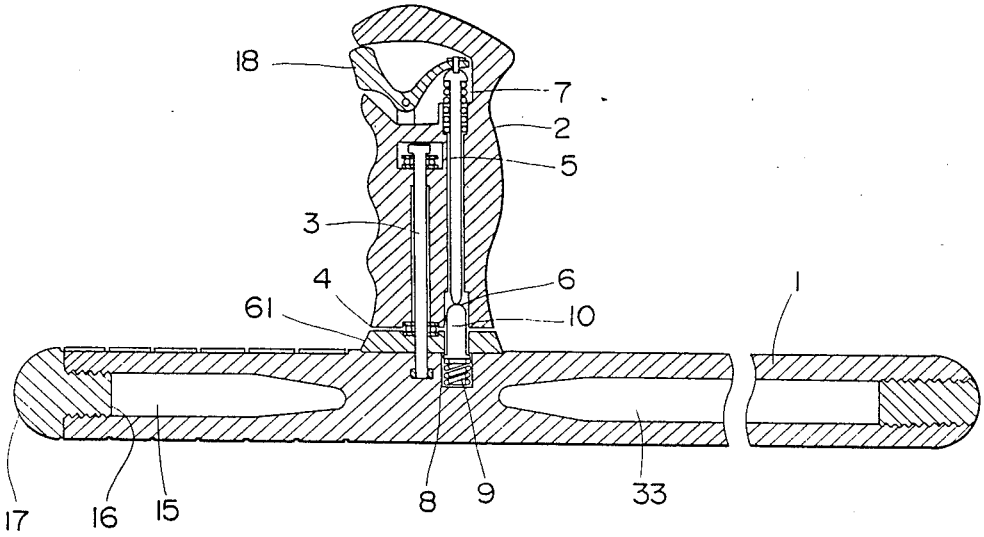
FIG. 5 shows a vertically sectioned view of the embodiment as shown in FIG. 4.
Figure 6:
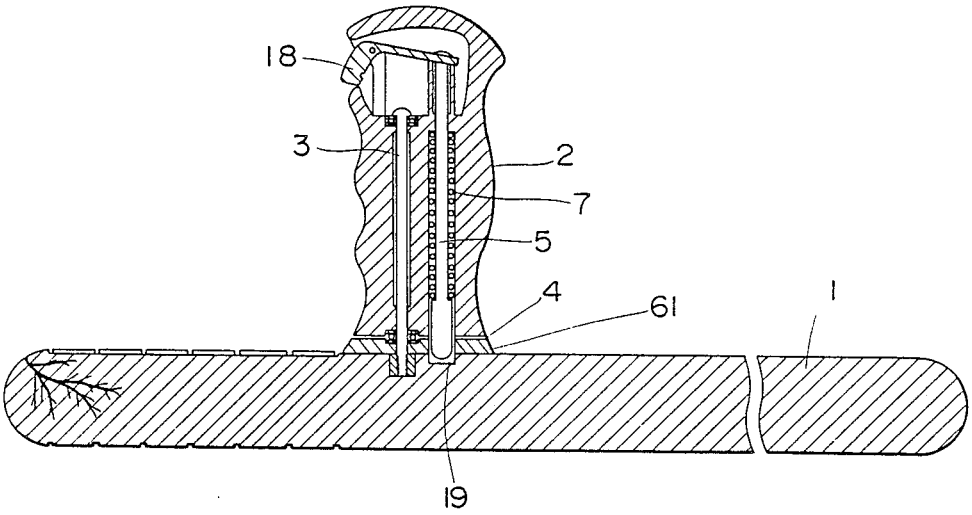
FIG. 6 shows a vertically sectioned view of a still another further inventive embodiment.
Figure 7:
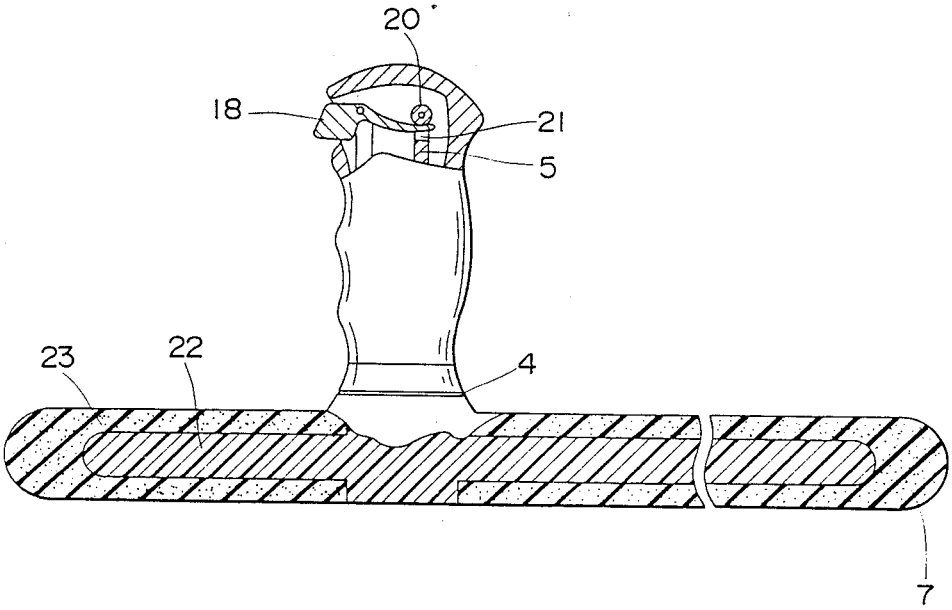
FIG. 7 shows a side view, mainly broken, to indicate internal structures.

With reference to FIGS. 4 and 5, this embodiment is comparable to the embodiment as shown in FIGS. 1 and 2 in respect to designs with a shaft 3 and a rod 5 and with attendant devices, but a trigger 18 is provided at a side face of the andle close to its far end and is internally extended to form a lever to contact with top or outmost end of the rod 5 so that a push of the trigger 18 will cause the rod 5 to a move inward. And longitudinal interior of the club 1 is divided to two spaces 15, 33 and each of opening 16 is closed by a plug 17. With reference to FIG. 6, an abbuting pin numbered 10 is removed and the rod 5 has a blocked head at its inner end and a coil spring 7 is set to wind around midportion of the rod 5 to urge the blocked head to be across the plane 4 and normally to be received in a recess 19 provided in the club 1, and a trigger 18 is formed to be a lever to engage with outermost end of the rod 5 such that a push of the trigger 18 will cause a move outwardly of the rod 5. With reference to FIG. 7, a trigger 18 is engaged in a hole 21 adjacent to a roller or roll 20 which is mounted at outmost end of the rod 5, and internal core portion 22 of the club 1 is made of a hard material, for instance, hard plastic, and wrapped or claded with an elastic, for instance, spongy material 23 to avoid a slip.

Figure 8:
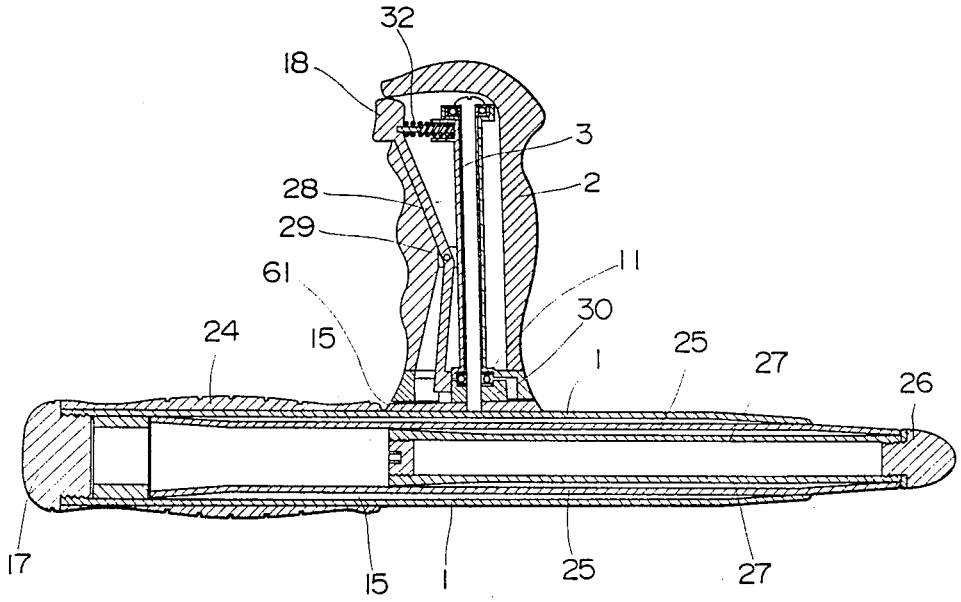
FIGS. 8 to 14 show vertically sectioned views to respectively indicate various devices mounted on inventive embodiments.

With reference to FIG. 8, internally of the handle 2, a shaft 3 is set up to be sheathed with a tube and at its close end, the shaft 3 is not extended in the club 1 and is secured in the mounting base 61, wherein another base member 30 is fixed integrally on the mounting base to further secure the shaft 3 and one side face of the base member 30 is made flush vertically with a cover of the ball bearing 11 for the shaft, which corresponds to close end of a tube sheathing the shaft 3. And further a rod is formed to be a slightly flexed lever 28 extending vertically in parallel to the shaft 3, and outmost end of the lever 28 is formed to be a trigger 18 to face out at a side of far end of the handle 2 and the trigger 18 is urged with a spring 32 which is set transversal to the sheath tube, and at a midpoint 29 the lever is pivoted, and at its close end or inner end, the lever 28 is blocked so as to press on both said ball bearing cover and said base member 30 with a slight gap inbetween such that normally, by pressing, the club 1 integral with the base member 30 is not allowed to turn, but a push of the trigger 18 will cause a release of the pressing, which will allow rotation around the shaft 3 wherein the base member 30 is involved in rotation.

Figure 9:
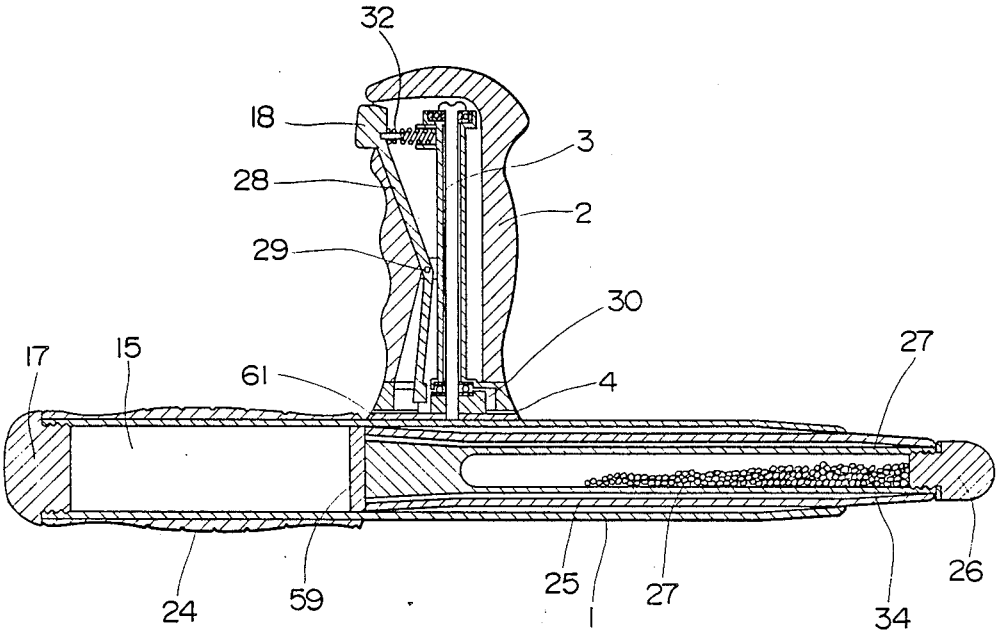

Making reference to devices accommodated in the club body 1 shown in FIG. 8 together with similar devices shown in FIG. 9 for convenience. In FIG. 8, the club 1 has an extending interior hollow space 15, an opening of one end adjacent to the handle is plugged by a plug 17, and another far end opening is made open to communicate outside, and in making use of the interior space, accommodated are a plurality of slender cylindrical members in retracted form which are extendable telescopically wherein a member 25 having a larger diameter than the other members is shaped to be thick at its end placed to be close to the plug 17 and thin at its end placed to be a slightly out of the open end of the club 1 to form a subtle taper forward as a whole, wherein an inner member 27 is so inserted as for its outer end to be fitted tightly with the end of the member 25, the outer opening end of the member 27 being plugged with a cap 26. These retracted members 25, 27 will be extended with help of centrifugal force when the club is gripped at the club grip 24 by a user and put into a swing motion, for instance.

Figure 10:
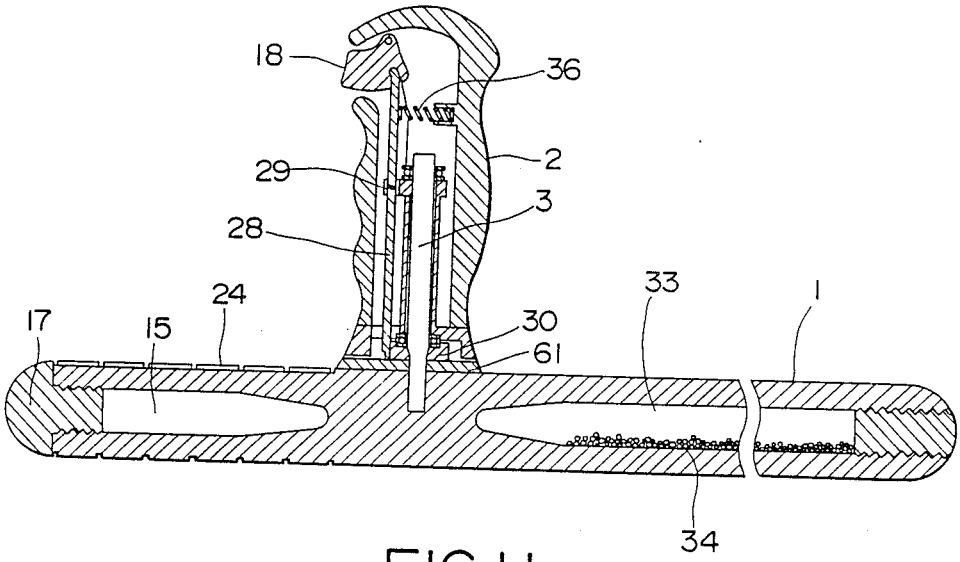

In FIG. 9, an outer member 25 is designed to be an outwardly tapered cylinder having an end wall 59 which is internally fixed midway of the club length and thereinto an inner member 27 is inserted, but it contains with help of the plug 26, metal beads or particles 34 to make a weight, which will accelerate the centrifugal force, wherein for the purpose of avoiding easy or unexpected extension of the members due to a small centrifugal force, fittings between the club end, the member 25 and the member 27 are made adequately tight. In the two drawings, 24 indicates a grip portion on the club as well as a cover placed on the portion to avoid slipping of the hand. With reference to FIG. 10, internal structures are featured as compared to those in FIG. 8, the lever 28 is urged at a point toward its far end with a spring 36 which is set up transversely on an internal wall of the handle 2. And the hollow space 15 is divided to two areas, of which ends are plugged and one space 33 contains metal particles 34 to make a weight.

Figure 11:
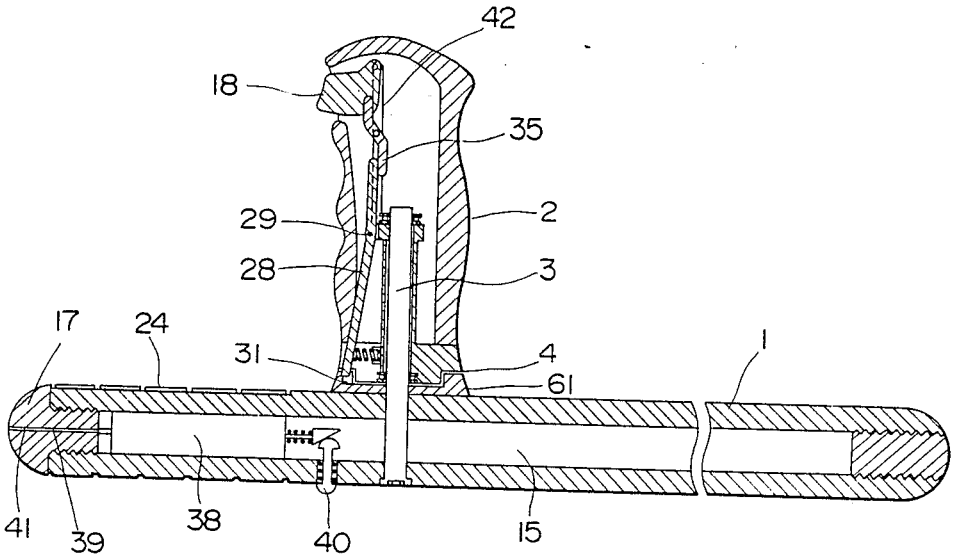

With reference to FIG. 11, internal structures of the handle 2 are featured as compared to those in FIG. 10, the lever 28 is not long outwardly enough to reach the trigger 18, wherein in an interspace between the trigger 18 and farthest end of the lever 28, another intermediate lever 35 is provided to connect a trigger action to the lever 28, and close end of the lever 28 is urged outwardly with a spring 36 set transversely on the sheath tube for the shaft 3 to press internally on both wall end of main portion of the handle 2 and a wall end 31 of the recessed mounting base 61 with a slight gap inbetween, which is in contrast to the embodiment of FIG. 8 in respect to which direction the pressing is designed to act on. In FIG. 8, inward, but in FIG. 11, outward. Additional feature in FIG. 11 is equipment of a gas ejecting device contained in the club body 1, wherein 38 is a gas bomb and 40 is a nob switch or trigger to burst the bomb and 39 is a gas ejecting nozzle, through which an exploded gas, for instance, tear gas or smoky gas will be ejected outside from a nozzle tip 41.

Figure 12:
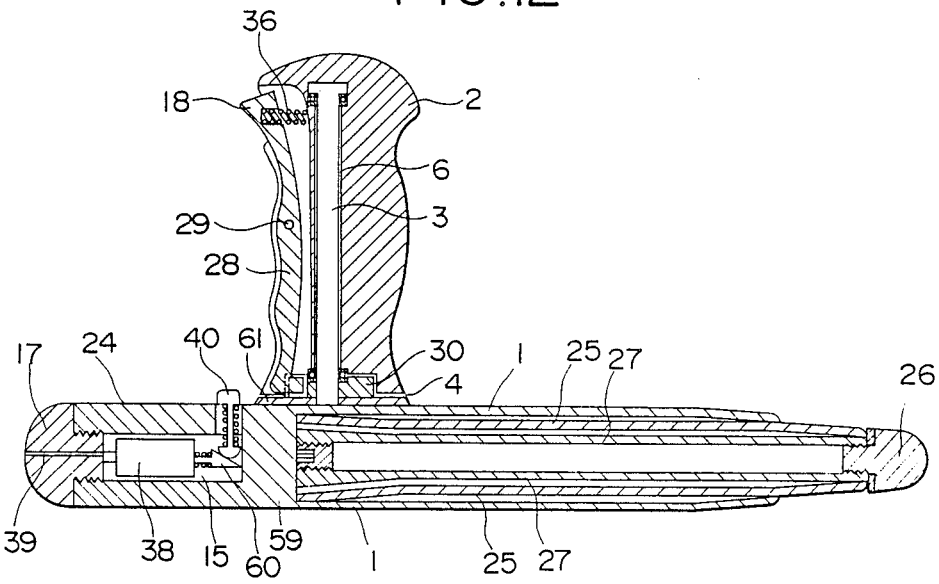

With reference to FIG. 12, first, as for devices internal of the handle 2, a shaft 3 is set at a center and a rod lever 28 is pivotally mounted generally in parallel to the shaft 3 at a off-center position and is formed at its far end to be a trigger 18 which is urged with a spring 36 set transversely and at its close end the lever 28 is designed to press on both a bearing cover and a base member which is formed on a mounting base 61 as in much the same manner as described in FIG. 8. Next, as for devices internal of the club body 1, interior space is divided to two rooms by a wall 59 and in a space 15, a gas bomb 38 is set such that a switch 40 located adjacent to the mounting base 61 will act, via a contact with a fuse 60, on the bomb 38 and in another space, a plurality of extendable members in a retracted form is accommodated in much the same manner as described in FIG. 9.

Figure 13:
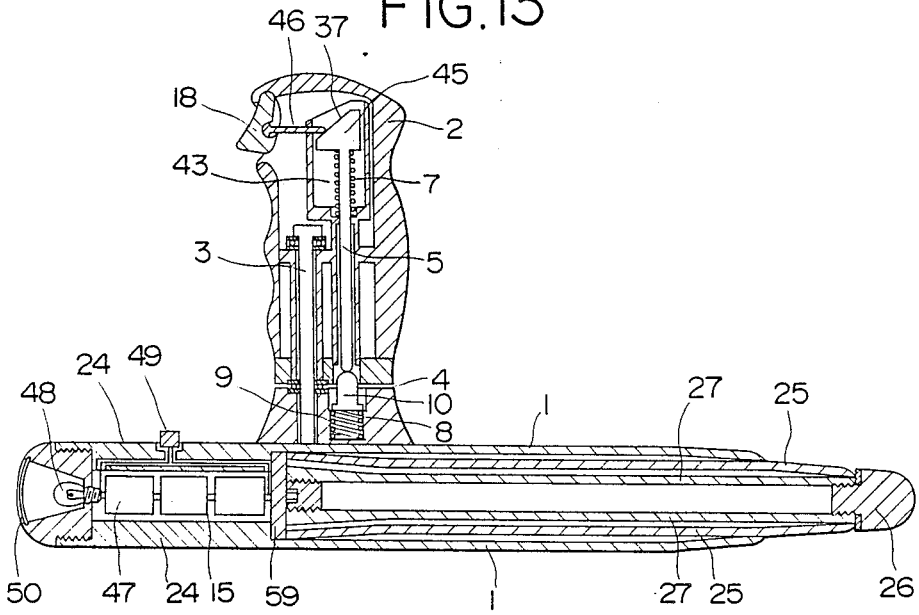

With reference to FIG. 13, this embodiment is compared to that in FIG. 1 in respect to arrangement of a shaft 3 and a rod 5, a new device is directed to connection of a trigger 18 to an end of the rod 5, disposed in a space 43 wherein a blocked shaped or end 45 is beveled to form an inclined face 37, close to which a ram 46 is set to transmit an action of the trigger 18 to the inclined face 37. And in equipment of the club interior, in place of the gas ejector in the foregoing, an illuminating device is provided wherein 47 is a battery, 48 is a lamp 49 is a lamp switch and 50 is a lens window as is easily understood and another space accommodates much the same device as described in the foregoing example.

Figure 14:
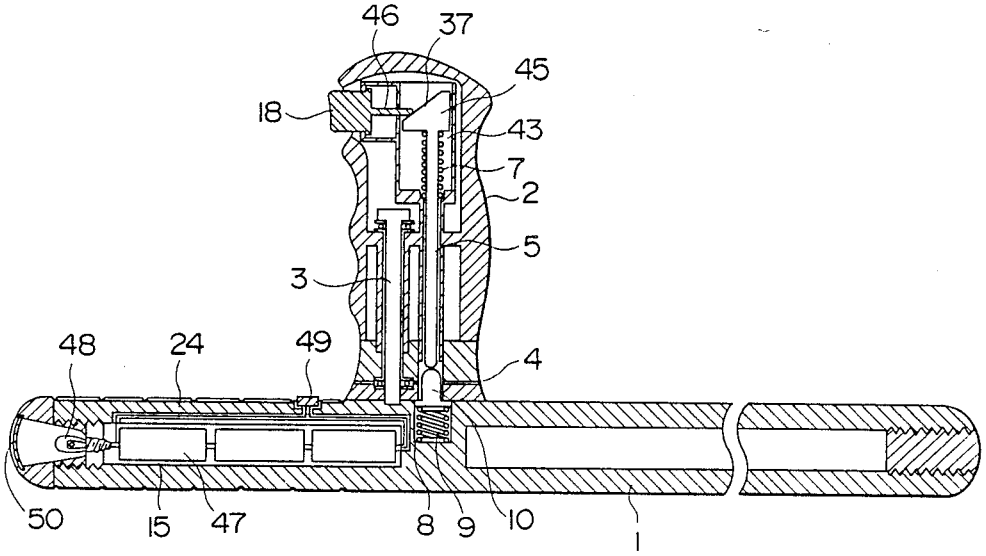

With reference to FIG. 14, in internal devices of the handle 2, a device for a trigger 18 is formed of a ram and piston to stroke in a cylinder, located to be adjacent to a beveled face 37 of a blocked head 45 of a shaft 5 in much the same manner in the foregoing example. And in internal devices of the club 1, an illumination device with much the same design as in the foregoing example is accommodated in the space 15 and another space is kept hollow.

Figure 15:
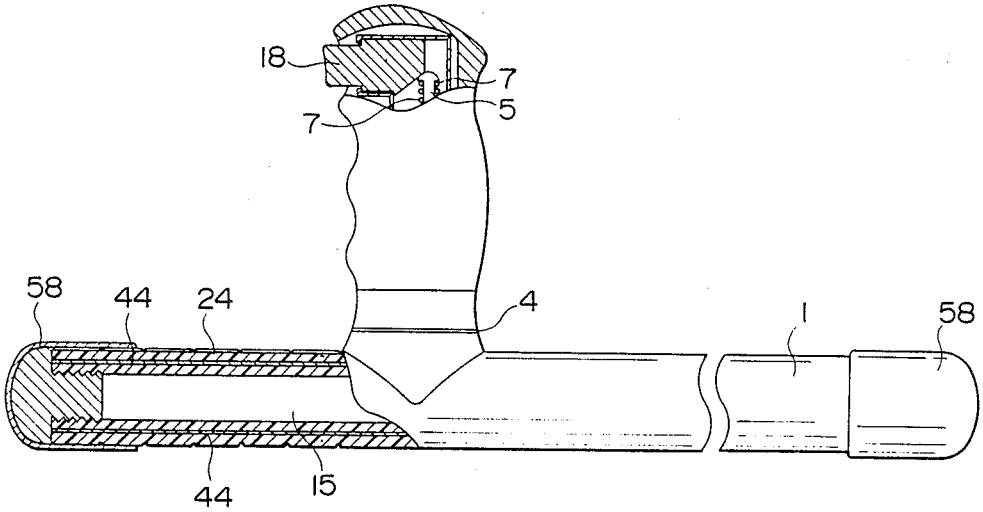
FIG. 15 shows a side view, partly broken, to indicate various internal devices.
Figure 16:
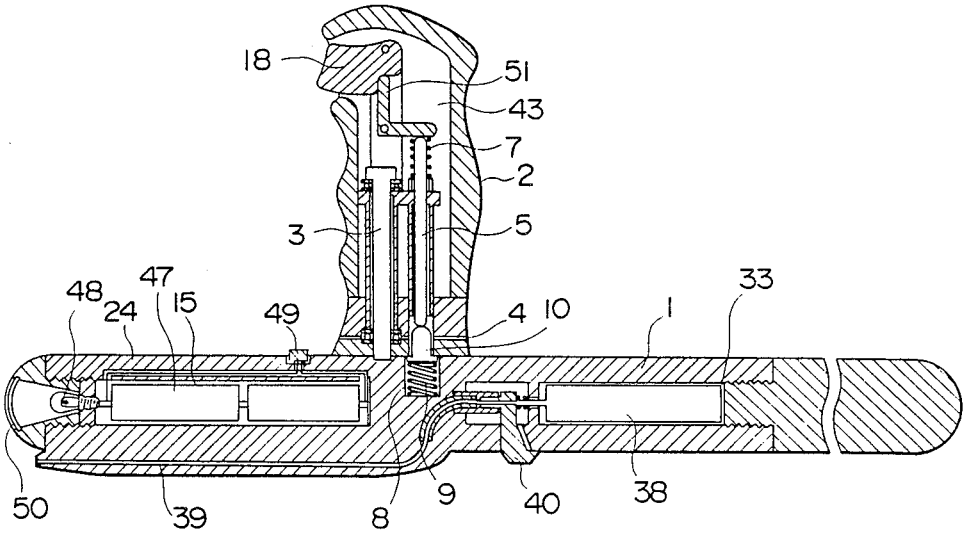
FIGS. 16 and 17 show vertically sectioned views to respectively indicate various devices mounted on embodiments of the invention. These drawings are presented by way of illustrating embodiments and therefore these should not be construed as limiting the invention. And through the drawings a like numeral indicates a like part with each embodiment. And it is to be noted here that in some drawings, a length of the club is shortened out of a normal scale without marking a cut, though, such should be understood not to destroy the invention.

With reference to FIG. 15, in internal devices of the handle 2, a trigger 18 is formed to be a ram having a beveled undercut to keep contact with a far end of a shaft 5. And at each of two ends of the club 1, a cap 58 is fitted over to avoid slipping for the hand, wherein the cap is preferably made of a spongy material. When the club 1 is made of a plastic, it is recommended to reinforce with making an interlacing layer 44 made of tough aramid fibers, for instance, Kevlar (brandname) by orienting such fibers to the longitudinal axis of the club. With reference to FIG. 16, in internal devices of the handle 2, new features are that in internal space 43 of the handle, a trigger 18 is set to swing by a push, underside of which a lever 51 shaped in a L letter pattern in section is suspended, and its lateral portion is set to be in contact on an end of a rod 5 such that a push of the trigger 18 will cause the rod 5 to move inwardly in much the same manner as described before. In internal devices of the club 1, an illuminating device and a gas ejecting device are accommodated, but a direction of casting light and that of ejecting gas are conformed as is shown to left in the drawing, wherein the device for ejecting a gas is set in the right-half space 33 and a nozzle 39 is directed to left therein.

Figure 17:
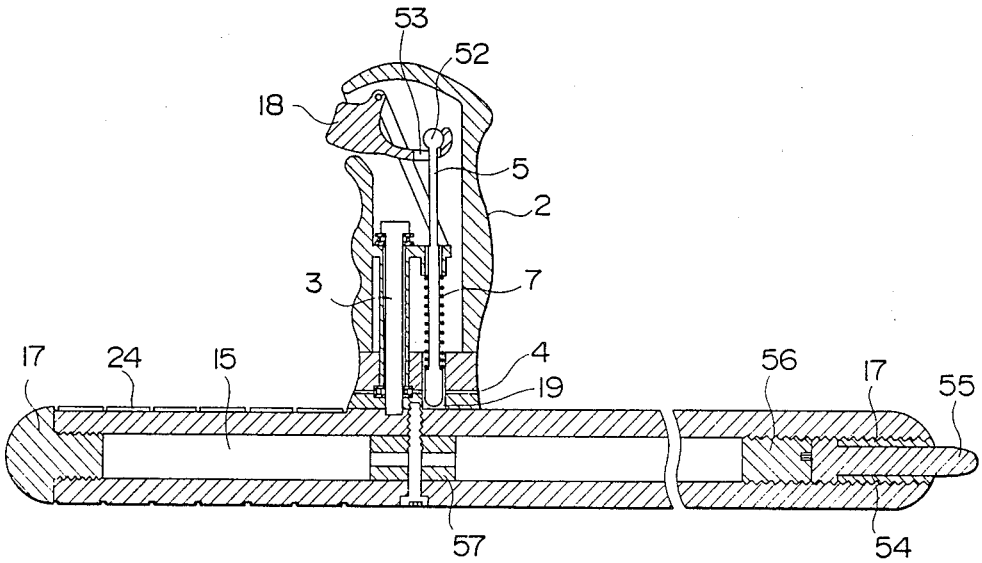

With reference to FIG. 17, in internal devices of the handle 2, new features are that a trigger 18 is extended inwardly to have a hole 53 and therethrough a blocked far end 52 of a rod 5 is threaded to make an engagement. In internal devices of the club 1, in a space adjacent to an end opposite to a grip portion 24 a pointing device is mounted so as to facilitate a jab action wherein a plug 17 is provided with a through hole 54 and therethrough a pointer member 55 is fitted and an assembly of the pointer 55 and the plug 17 is set so as to connect to a pack 56 mounted inwardly wherein a tip of the pointer 55 is adjusted to be slightly out of the rod end, and 57 is a shock absorber.

Conclusive Statement

The invention being thus described, it will be obvious that the same may be varied in many ways. Such variations are not to be regarded as a departure from the spirit and scope of the invention, and all such modifications as would be obivous to one skilled in the art are intended to be included within the scope of the following claims.

What is claimed is:

1. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft rotatably supported internally of said crosshandle, one end of said shaft being secured to a mounting base formed on said club and providing a rotary slide plane between said crosshandle and said mounting base;

a rod provided internally of said crosshandle and having a round tip adjacent to the club, said rod having an axis parallel to said shaft and being axially movable relative to said crosshandle;

a pin mounted in a bore formed in said club and a coil spring biasing said pin coaxially into abutment with the round tip of the rod internally of said crosshandle;

whereby said pin is biased by said coil spring to extend across said slide plane and prevent turning movement of the club and said pin is movable by axial movement of the rod to a position flush with said slide plane to permit turning movement of said club relative to the crosshandle.

2. A crosshandled guard baton as defined by claim 1 and further including a trigger biased to extend through an aperture in a side surface of said crosshandle, said trigger having a ram extending transverse of said crosshandle toward an end of said rod which is remote from said club, a head having a beveled surface provided at said end of said rod with said trigger ram contacting said bevel surface, a coil spring biasing said rod away from said club and said trigger is operative through said ram and said bevel surface to move said rod to said position to permit turning movement of said club relative to the crosshandle.

3. A crosshandled guard baton as defined by claim 1 and further including a trigger biased to extend through an aperture in a side surface of said crosshandle, said trigger having a beveled surface internal of said crosshandle and in abutment with an end of said rod which is remote from said club, a coil spring biasing said rod away from said club, and said trigger is operative through said bevel surface to move said rod to said position to permit turning movement of said club relative to said crosshandle.

4. A crosshandled guard baton as defined by claim 1 and further including, a trigger biased to extend through an aperture in a side surface of said crosshandle, an L-shaped lever pivotally mounted internally of said crosshandle, one leg of said L-shaped lever is received in an undercut formed in said trigger and the other leg of said L-shaped lever abuts an end of said rod which is remote from said club, and said trigger is operative when pressed inwardly to pivot said L-shaped lever and move said rod to said position to permit turning movement of said club relative to the crosshandle.

5. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft supported internally of said crosshandle for rotary and axial movement relative to said crosshandle, one end of said shaft being secured to said club; and a stopper pin extending across a slide plane between said crosshandle and the club, one end of said stopper pin being secured to the club and the other end seated in a recess in said crosshandle and facing said club;

whereby said stopper pin prevents turning movement of the club when the stopper pin is seated in said recess and said stopper pin is moveable out of said recess with said club upon axial movement of said shaft relative to said crosshandle to permit turning movement of said club relative to the crosshandle.

6. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft rotatably supported internally of said crosshandle, one end of said shaft being secured to a mounting base formed on said club and providing a rotary slide plane between said crosshandle and said mounting base;

a rod provided internally of said crosshandle, said rod having a round tip at one end adjacent to the club and a distal end remote from the club, said rod having an axis parallel to said shaft and being axially movable relative to said crosshandle;

a lever pivotally connected to said crosshandle, said lever having one end connected to said distal end of said rod internally of the crosshandle and an outer end formed as a trigger operative to pivot said lever and axially displace said rod internally of said crosshandle;

a pin mounted in a bore formed in said club and a coil spring biasing said pin coaxially into abutment with the round tip of the rod internally of said crosshandle;

whereby said pin is biased by said coil spring to extend across said slide plate and prevent turning movement of the club and said pin is moveable by said axial displacement of the rod to a position flush with said slide plane to permit turning movement of said club relative to the crosshandle.

7. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft rotatably supported internally of said crosshandle, one end of said shaft being secured to a mounting base formed on said club and providing a rotary slide plane between said crosshandle and said mounting base;

a rod provided internally of said crosshandle, said rod having shaped tip at one end which is receivable in a bore provided in the club and a distal end remote from the club, said rod having an axis parallel to said shaft and being axially moveable relative to said crosshandle;

a lever pivotally connected to said crosshandle, said lever having one end connected to said distal end of said rod internally of the crosshandle and an outer end formed as a trigger operative to pivot said lever and axially displace said rod internally of said crosshandle; and means normally biasing said shaped tip at one end of said rod into said bore, whereby said rod extends across said slide plane to prevent turning motion of the club and said outer end of said lever is manually actuable to retract said shaped tip of said rod across the slide plane and permit turning movement of the club relative to the crosshandle.

8. A crosshandled guard baton as defined by claim 7, wherein a roller is rotatably mounted to said distal end of said rod, an aperture is provided between said roller and an adjacent portion of said rod and said one end of said lever is inserted in said aperture.

9. A crosshandled guard baton as defined by claim 7 wherein an aperture is provided adjacent said one end of said lever, a head is formed at said distal end of said rod and said distal end of said rod is inserted through said aperture with said head connecting said rod to said lever.

10. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft rotatably supported internally of said crosshandle with a sheathing tube, one end of said shaft being secured to said club;

a lever pivotally mounted internally of said crosshandle and extending lengthwise in a direction substantially parallel to said shaft;

means biasing one end of said lever to a position pressing on an end portion of said sheathing tube and a base member fixed on said club to prevent turning movement of said club relative to the crosshandle; and the other end of said lever being formed as a trigger operative when pressed to withdraw said one end of said lever from pressing on said end portion of said sheathing tube and said base member to permit turning movement of said club relative to the crosshandle.

11. A crosshandled guard baton as defined by claim 10 wherein said one end portion of said lever is shaped to press on an end portion of said sheathing tube and said base member, said means biasing said lever is a spring set transversely between said other end of said lever and an internal surface of said crosshandle, and said lever is pivotally mounted to said crosshandle at a midpoint of said lever.

12. A crosshandled guard baton which comprises:

a club having a longitudinal axis;

a crosshandle transversely branched on the club at a place toward one end of said club, said crosshandle having a cross-section of elliptic shape with the major axis of the elliptic shape substantially parallel to the longitudinal axis of said club and a branching length substantially equal to the width of a man's palm;

a shaft rotatably supported internally of said crosshandle with one end of said shaft secured to said club, a trigger mounted for movement relative to said crosshandle, a first lever pivotally mounted internally of said crosshandle and extending lengthwise in a direction substantially parallel to said shaft;

means biasing one end of said first lever to a position pressing on a base member fixed on said club and a peripheral portion of an internal wall of said crosshandle, and a second lever pivotally mounted internally of said crosshandle, said second lever having one end positioned to contact a second end of said first lever and a second end positioned for contact by said trigger, wherein said second end of said second lever is movable in response to movement of said trigger to pivot said second lever thereby causing said first end of said second lever to move said second end of said first lever and pivot said one end of said first lever away from said position pressing on said base member and said internal wall thereby permitting turning movement of said club relative to said crosshandle.

13. A crosshandled guard baton as claimed in any of claims 1, 5, 6, 7 or 10, wherein the crosshandle is provided with a ring strap for engagement with a user's hand.

14. A crosshandled guard baton as claimed in any of claims 1, 5, 6, 7 or 10, wherein the club is formed internally as a hollow cylinder, one end of said club close to the crosshandle is plugged and the other end of the club is open;

an elongate member is inserted in said club, said elongate member includes at least one telescopically extendable inner member and has a larger diameter at one end which is inserted toward the plugged end of the club;

whereby said at least one inner member extends telescopically outward of said club by centrifugal force produced by swinging motion of said club.

15. A crosshandled guard baton as claimed in any of claims 1, 5, 6, 7 or 10, wherein the club is wrapped with an anti-slip elastic material.

16. A crosshandled guard baton as claimed in any of claims 1, 5, 6, 7 or 10, wherein the club is provided longitudinally with a plurality of interior hollow spaces separated from each other, a hollow space at one end of the club is open to communicate externally of the club and a hollow space at another end of said club is closed by a plug.

17. A crosshandled guard baton as claimed in claim 16, wherein a weight is provided internally of the hollow space closed by a plug.

18. A crosshandled guard baton as claimed in claim 16, and further comprising a gas ejecting device in said hollow space at said one end of the club, said device is operative to direct gas outside the club, and manual means for operating the gas ejecting device.

19. A crosshandled guard baton as claimed in claim 16, wherein the guard baton further includes an illuminating device in the hollow space at said one end of the club, said device is operative to direct light outside the club, and manual means for operating said illuminating device.

20. A crosshandled guard baton as claimed in claim 16, wherein the club is separated at the mounting base into two interior hollow spaces, an illuminating device is provided in one of said hollow spaces, a gas ejecting device is provided in the other hollow space, and manual means for independently operating the illuminating device and the gas ejecting device are provided adjacent the crosshandle.

21. A crosshandled guard baton as claimed in any of claims 1, 5, 6, 7 or 10, wherein the club is provided with a removable anti-slip device at at least one end of said club.

22. A crosshandled guard baton as claimed in any of claims 1, 5, 6, 7 or 10, wherein the club is provided with a removable anti-slip cap at at least one end of said club.

* * * * *